US006618966B2

(12) United States Patent
Russo et al.

(10) Patent No.: US 6,618,966 B2
(45) Date of Patent: Sep. 16, 2003

(54) FLUID LANCE APPARATUS

(75) Inventors: Frank P. Russo, Swiftwater, PA (US); William M. Hutton, Nazareth, PA (US); Jeffery C. Bond, Blakeslee, PA (US); John K. Gilday, Staten Island, NY (US)

(73) Assignee: Omega Tools Inc., Portland, PA (US)

( * ) Notice: Subject to any disclaimer, the term of this patent is extended or adjusted under 35 U.S.C. 154(b) by 0 days.

(21) Appl. No.: 10/040,555

(22) Filed: Nov. 7, 2001

(65) Prior Publication Data

US 2003/0041484 A1 Mar. 6, 2003

Related U.S. Application Data

(63) Continuation-in-part of application No. 09/948,313, filed on Sep. 6, 2001.

(51) Int. Cl.[7] ..... E02F 3/90; E02F 5/02

(52) U.S. Cl. ..... 37/335; 37/344; 37/347; 239/522; 239/DIG. 21; 299/17; 175/212

(58) Field of Search ..... 37/335, 323, 342, 37/344, 905; 239/525, 526, 527, 532, DIG. 21; 299/17, 81.3; 175/67, 212, 218, 205

(56) References Cited

U.S. PATENT DOCUMENTS

| | | | | | |
|---|---|---|---|---|---|
| 628,781 | A | * | 7/1899 | Farrington et al. | 405/131 |
| 967,797 | A | * | 8/1910 | Lovett | 37/322 |
| 1,180,664 | A | * | 4/1916 | Littlehales | 37/309 |
| 2,121,858 | A | * | 6/1938 | Chew | 175/213 |
| 2,369,357 | A | * | 2/1945 | Kunz | 239/446 |
| 2,557,247 | A | * | 6/1951 | Ziherl | 417/540 |
| 3,019,535 | A | * | 2/1962 | Talbott et al. | 37/344 |
| 3,402,487 | A | * | 9/1968 | Vaughan et al. | 37/344 |
| 3,421,392 | A | * | 1/1969 | Bangerter et al. | 408/57 |
| 3,572,839 | A | * | 3/1971 | Okabe | 299/17 |
| 4,009,666 | A | * | 3/1977 | Russell et al. | 111/127 |
| 4,288,886 | A | * | 9/1981 | Siegler | 15/330 |
| 4,352,251 | A | * | 10/1982 | Sloan | 37/323 |
| 4,437,525 | A | * | 3/1984 | O'Hanlon et al. | 175/218 |
| 4,491,368 | A | * | 1/1985 | Uittenbogaard | 299/17 |
| 4,930,706 | A | * | 6/1990 | Merlin | 239/754 |
| 4,936,031 | A | * | 6/1990 | Briggs et al. | 37/347 |
| 5,004,382 | A | * | 4/1991 | Yoshino | 408/68 |
| 5,152,126 | A | * | 10/1992 | Cousineau | 37/342 |
| 5,170,943 | A | * | 12/1992 | Artzberger | 239/532 |
| 5,212,891 | A | * | 5/1993 | Schuermann et al. | 37/323 |
| 5,901,478 | A | * | 5/1999 | Sawyer, Jr. | 37/323 |
| 5,966,847 | A | * | 10/1999 | Nathenson et al. | 37/347 |
| 6,470,605 | B1 | * | 10/2002 | Gilman et al. | 37/323 |

FOREIGN PATENT DOCUMENTS

WO 0251660 * 1/1988

OTHER PUBLICATIONS

Prodders and Probes Publication WWW.mechl.uwa.edu.au/jpt/demening/needs/eq–prod–probe.html, Air Spade, dated Aug. 1998.

Concept Engineering Group, WWW.air–spade.com, Air Spade, date unknown.

* cited by examiner

*Primary Examiner*—Robert E. Pezzuto
*Assistant Examiner*—Thomas A. Beach
(74) *Attorney, Agent, or Firm*—Paul & Paul

(57) ABSTRACT

The present invention is a lance for removing dirt or other substances from an underground hole, by the use of air and water under high pressure. The water is used as an abrading material or lance to loosen dirt in a hole or to pick or chip off substances which are attached to a pipe. A limited amount of water is used during the operation of the apparatus, to prevent the formation of wet mud.

17 Claims, 5 Drawing Sheets

FLUID LANCE APPARATUS

CROSS-REFERENCE TO RELATED APPLICATIONS

This is a continuation-in-part application of U.S. application Ser. No. 09/948,313 filed Sep. 6, 2001.

BACKGROUND OF THE INVENTION

Vacuum excavation systems are known in the art of excavation. Particularly, for many years, utility companies and contractors have used vacuum excavation technology for accessing underground utility lines, such as gas lines, water lines, electric lines, sewer lines, etc. For most of those many years, the technology has experienced problems resultant from the material being handled. For example, clogged hoppers, poor filtration, inefficient dirt handling, equipment failure (often as a result of contamination by the dirt or other material being handled), and particularly the inability to handle water that may seep in the hole that is being evacuated, have plagued the art of vacuum excavation.

During the past year, Omega Tools and Keyspan Energy addressed one of these technical limitations by jointly developing a technology known as wet air digging system. This advancement has proven to have extensive advantages over conventional soil disturbances tools such as air lances and water jets. The "wet air" system is superior to conventional tools because is has the ability to disturb all types of soils at a rapid rate without possessing the inherent disadvantages of the conventional soil disturbance methods. Essentially, air knifes work well in porous soils producing dry excavated material for backfill (their advantage over water jets). However, they do not work well in non-porous soils such as clay. On the other hand, water jet systems disturb all forms of soil effectively (their advantage over air knifes) both excavated material is water soaked slop and as such is not usable for backfill. The wet air system possesses the advantages of both air knives and water jets without possessing any of their disadvantages.

SUMMARY OF THE INVENTION

The present invention is a fluid lance apparatus using a minimal amount of water droplets as an abrading medium, with compressed air as a primary medium. Upon excavation of the surface material, which can be asphalt, sod etc., dirt must be removed to provide access to an underground pipe. The tool of the present invention performs the task of disturbing earth or dirt by the use of high pressure air which propels water droplets into an underground hole, and in many cases to access an underground pipe without using equipment which may damage the pipe. The density of the water droplets, when added to the compressed air acts as a lance to disturb or "break-up" the dirt. The loosened dirt is then removed by vacuum. Furthermore, because the amount of water used in conjunction with compressed air is minimal, the hole can be refilled with the removed dirt, which, rather then comprising mud, is dry dirt.

Accordingly, it is the primary objective of this invention to provide a fluid lance tool which can disturb earth and other substances from an underground hole, wherein the fluid lance is comprised of compressed air means as a carrier medium and means providing minimal amount of water as an abrading medium, carried by the carrier medium.

It is a further object of the present invention to provide a tool which uses water droplets as an abrading material for removal of substances from the area around a utility to be repaired.

It is a further object of the present invention to provide a tool which uses a minimal amount of water so the hole can be refilled with dry dirt.

Other objects and advantages of the present invention will be readily understood upon a reading of the following brief description of the drawings figures, the detailed descriptions of the preferred embodiment and the appended claims.

BRIEF DESCRIPTION OF THE DRAWINGS

Like reference numbers denote like elements throughout the figures.

DETAILED DESCRIPTION OF THE INVENTION

Figure 1:
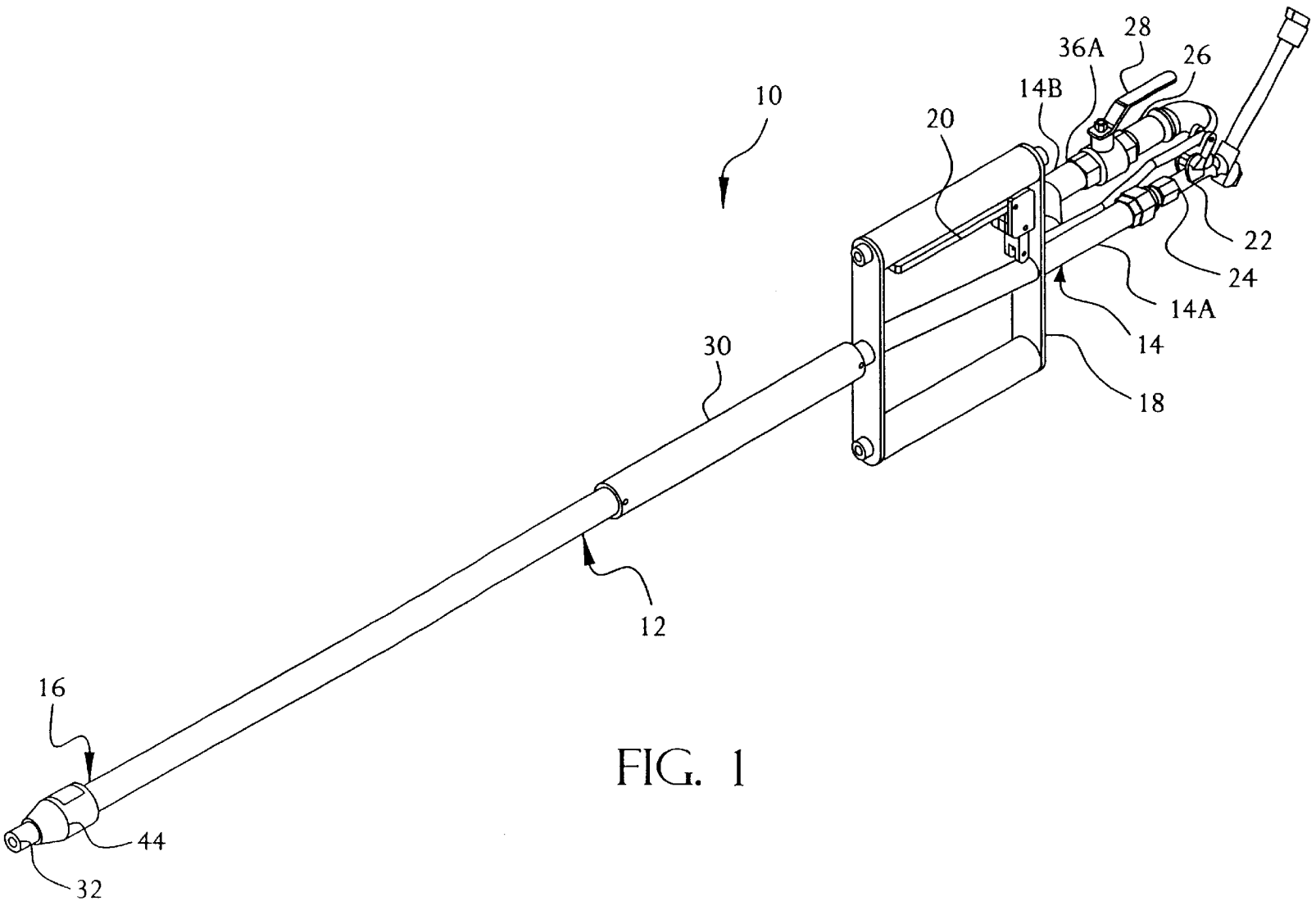
FIG. 1 is a perspective view of the lance apparatus of the present invention.
Figure 2:
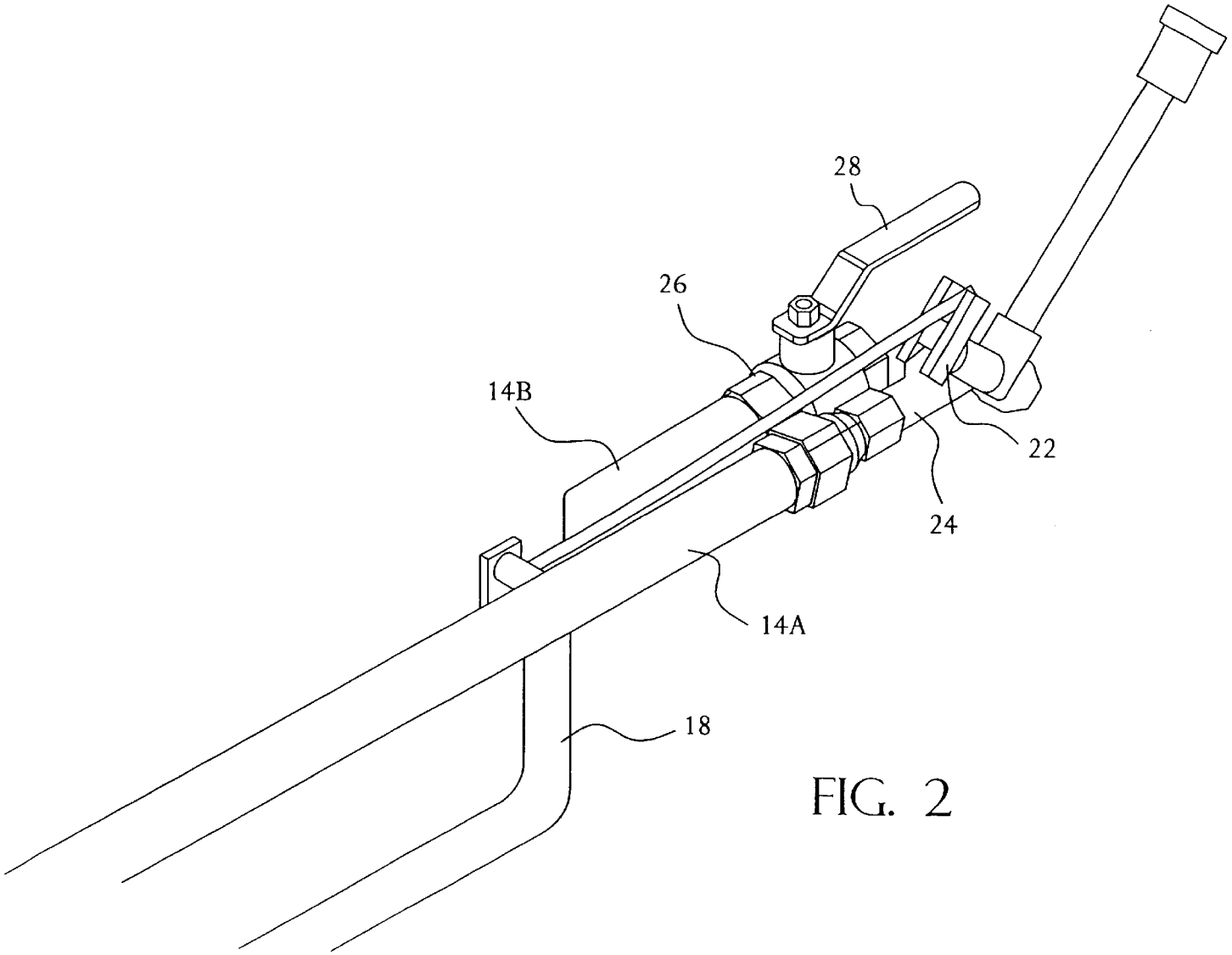
FIG. 2 is a partial view of the handle portion of the lance apparatus of the present invention.

Referring to FIG. 1, the lance 10 is shown having a body shaft 12 having a forked end 14, dividing into a first prong 14A and a second prong 14B, and a second end 16. Proximal to the forked end 14 is a handle 18 having a lever 20 operably attached to a water valve link 22 attached to a water input valve 24 on said first prong 14A as a means for regulating water entering said water input valve 24. On said second prong 14B is an air input valve 26 having an attached air control lever 28 as a means for regulating air entering said air input valve 26. An air insulator tube 30 encases said body shaft 12 about midway between said first prong 14A of said forked end 14 and a nozzle 32 at said second end 16. Due to the high temperature of the air from the air source (not shown), the air insulator tube 30 is made of a non-heat conductive material to allow gripping of the body shaft 12 while the air is traversing said body shaft 12.

Figure 3:
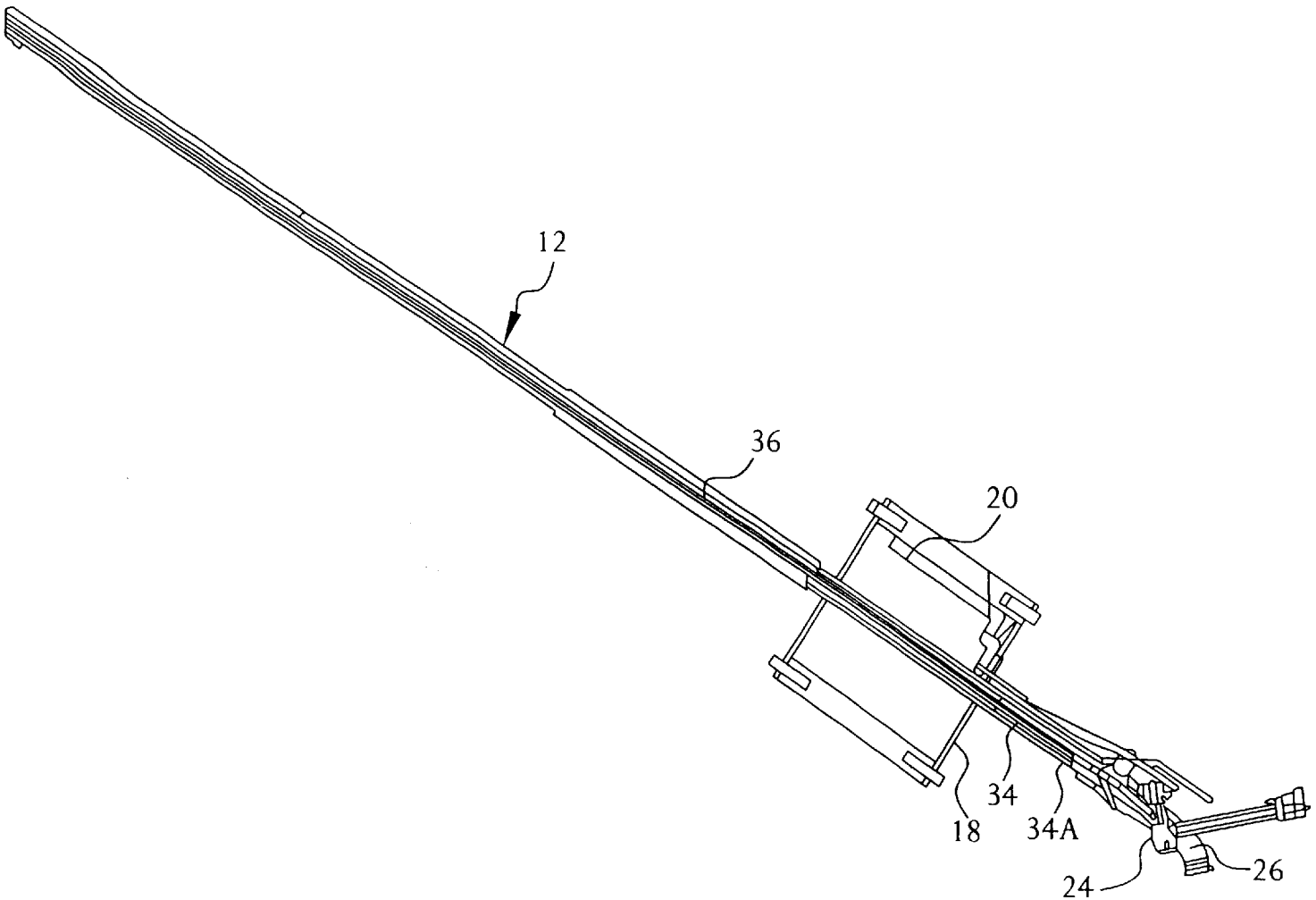
FIG. 3 is a cross-sectional view of the lance of the present invention.

During operation of the apparatus 10, a water source (not shown) forces water into said water input valve 24 and down a water tube 34 connected at its proximal end 34A thereto (as best illustrated in FIG. 3). This flow of water is controlled by the opening and closing of the valve link 22 by the lever 20. Simultaneously, an air source (not shown) forces air at perhaps 120 psi, or within the range of 100 psi to 150 psi, into said air input valve 26 and down an air tube 36 connected at its proximal end 36A thereto. This flow of air is controlled by the opening and closing of the lever 28 attached to the air input valve 26.

Figure 4:
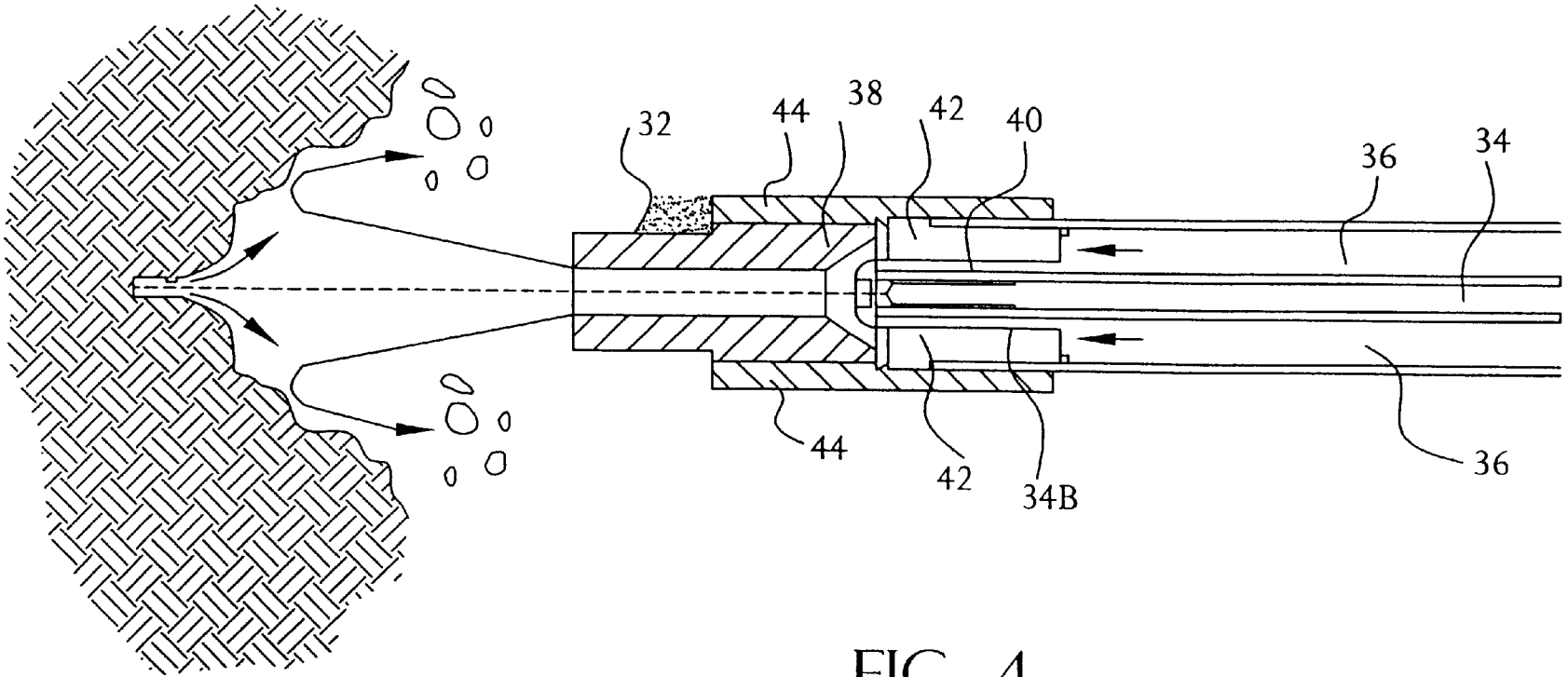
FIG. 4 is a cross-section view of the nozzle portion of the lance of the present invention.

The water tube 34 encircled by the air tube 36 extend the length of the body shaft 12 and exit into a nozzle funnel 38 located within the nozzle 32 (as best illustrated in FIG. 4). The distal end 34B of the water tube 34 has an attached tap through valve 40 that reduces the pressure of the water flow in the water tube 34. Surrounding the tap through valve 40 is a finned element 42 that maintains the position of the water tube 34 within the body shaft 12 while allowing air to pass and thereafter exit the nozzle 32. Surrounding and securing the nozzle 32 is a nozzle retention nut 44 attached on the outside of the body shaft 12.

As best illustrated in FIG. 4, air from the air tube 36 (illustrated by the arrows) and water from the water tube 34 (illustrated by dashed lines) converge as they flow through the nozzle funnel 38 until they exit the nozzle 32 to contact the materials to be dislodged. Substances (dirt) are dislodged by bombardment of the water droplets as an abrading material. The operator directs a short burst pattern of water droplet bombardment by activation of the lever 20, thus limiting the amount of water in the access hole. Thereafter, the dislodged substances are vacuumed away and the pipe is cleaned and ready for repair.

Figure 5:
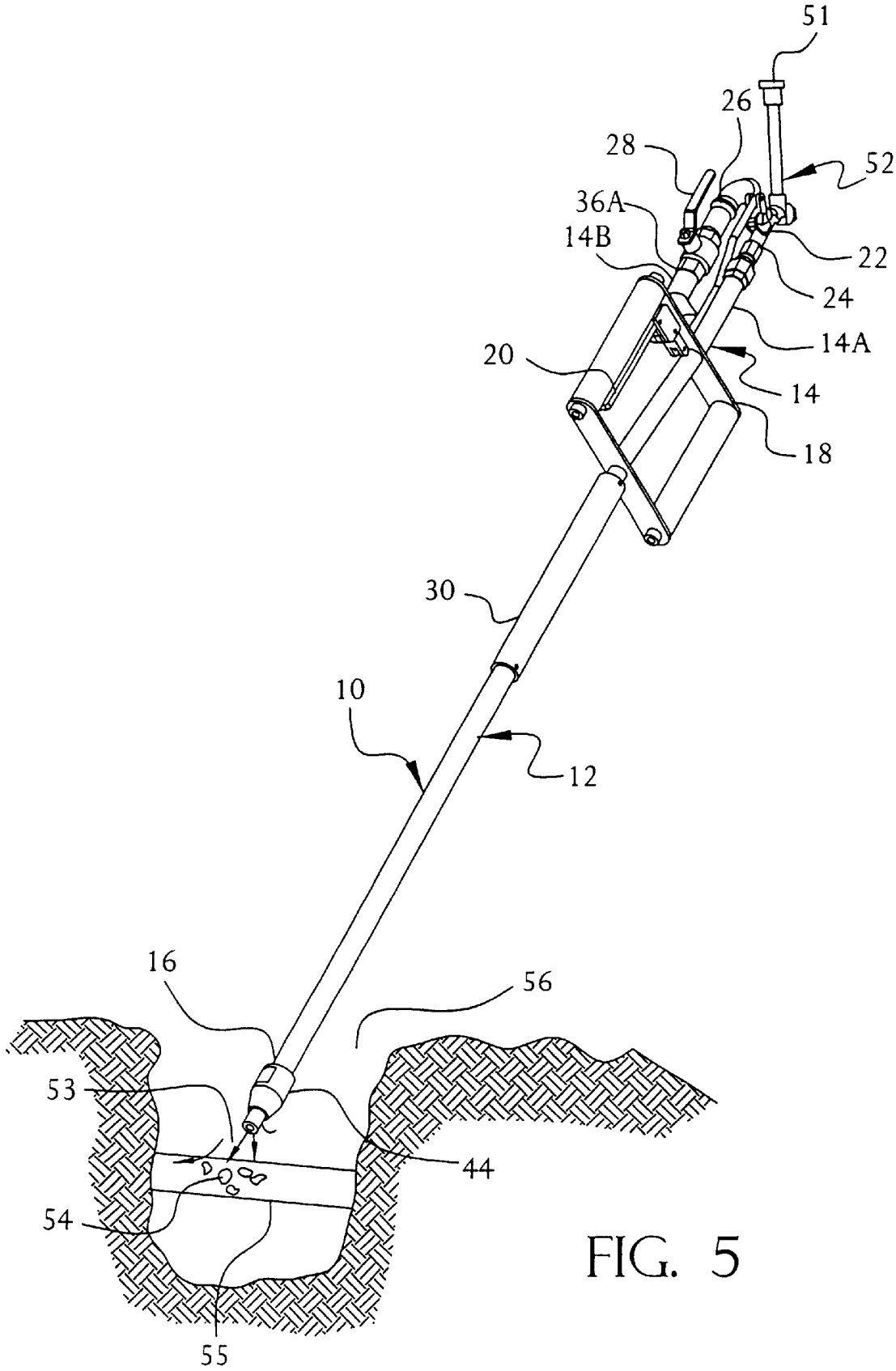
FIG. 5 is an illustration of the tool of FIG. 1, delivering water as an abrading medium to a pipe in a hole.

FIG. 5 shows the tool 10 of FIG. 1, with water delivered at 51 and compressed air delivered and at 52, with water droplets being provided as an abrading medium, carried by compressed air as a carrier medium, to be delivered through the tool 10 and discharged from the nozzle 32 as seen by the arrows 53, whereby dirt particles 54 that are present on the pipe 55 in hole 56 can be removed from the pipe 55. It will be understood that, prior to reaching the pipe 55, dirt from a location above and around the pipe 55 can be disturbed via the tool 10 of this invention. The minimal use of water would be typified by delivering water 1 to 2 ounces per second as an abrading medium, in compressed air at preferably greater than 100 cubic feet per minute and perhaps 300 cubic feet per minute as a carrier medium. The delivery of water at 2 gallons per minute in short burst can be optimum for some situations.

We claim:

1. A lance apparatus using water droplets as an abrading medium carried within a compressed air primary medium, comprising:

a body having a first and second ends and a first and second inlets at said first end thereof;

a water input valve attached to said first inlet;

a compress air valve attached to said second inlet;

a first control member for operating said water input valve for setting the position thereof;

a second control member for operating said air input valve for setting the position thereof; and a nozzle attached to said second end of said body wherein said first and second inlets are each connected to said nozzle;

wherein a limited amount of flow from said water inlet valve is permitted to join with the flow from said air inlet valve in said nozzle whereby said lance apparatus is capable of disturbing dirt with said water bearing air stream therefrom.

2. The lance apparatus of claim 1, wherein said nozzle includes a funnel member which causes said water flow to mix with said air flow.

3. The lance apparatus of claim 2, wherein body includes an internal air tube, having a proximal end and distal end with said proximal end thereof attached to said air input valve, and a central water tube, having a distal end and a proximal end with said proximal end thereof attached to said water valve, whereof said air tube surrounds said water tube.

4. The lance apparatus of claim 3, wherein said distal end of said air tube and said distal end of said water tube each feed into said nozzle funnel, wherein air from said air tube and water from said water tube are combined and forced to exit said nozzle.

5. The lance apparatus of claim 4, wherein said central water tube has a tap through valve at said distal end of said central water tube for reducing the water pressure of the water flowing through said water tube.

6. The lance apparatus of claim 5, wherein said distal end of said central water tube is surrounded by a finned element which maintains the position of the water tube within the body shaft.

7. The lance apparatus of claim 1, wherein said nozzle is secured to said body by a retention nut.

8. The lance apparatus of claim 1, wherein said second control member for operating said water input valve includes a lever attached to a water valve link said link being attached to said water input valve.

9. The lance apparatus of claim 1, wherein said means for regulating the air entering through said air input valve is an air control lever attached to said air input valve.

10. The lance apparatus of claim 1, wherein said body includes a thermal insulator.

11. A fluid lance, for disturbing dirt without generating mud from the dirt, comprising:

a compressed air means for providing an air carrier medium output discharge;

means for delivering a water medium into said air carrier medium prior to its output discharge and for causing particles of said water medium to be entrained in said air carrier medium as an abrading medium; and means for directing said air carrier medium carrying said abrading water medium towards said dirt to be disturbed;

wherein said water medium abrades said dirt and said air carrier medium carries away said abraded dirt without rendering said dirt substantially wet.

12. The fluid lance of claim 11, wherein said means for delivering said water medium includes means for delivering one to two ounces per second of said water medium.

13. The fluid lance of claim 12, wherein said compressed air providing means delivers at least 100 cubic feet per minute of said air carrier medium through said fluid lance.

14. A method of disturbing dirt without generating substantial mud, comprising the steps of:

providing compressed air as a carrier medium for delivering an abrading medium;

providing water as an abrading medium into said compressed air carrier medium and causing particles of said water provided to be entrained in said air carrier medium; and discharging said air carrier medium with said entrained water abrading medium particles into said dirt;

wherein the amount of water delivered as an abrading medium relative to the amount of air delivered as a carrier medium in said discharge into said dirt, is sufficient to abrade said dirt but insufficient to render said dirt substantially wet.

15. The method of claim 14, wherein the amount of water delivered in said discharge is less than 120 ounces per minute.

16. The method of claim 15, wherein the amount of compressed air delivered in said discharge is at least 100 cubic feet per minute.

17. The method of claim 16, wherein said provided compressed air is pre-heated.

* * * * *